US006568137B2

(12) United States Patent
Ballantyne

(10) Patent No.: US 6,568,137 B2
(45) Date of Patent: May 27, 2003

(54) INSULATED METAL CLADDING FOR WOOD DOOR FRAME

(76) Inventor: Michael Alexander Ballantyne, 3410 Malcolm Rd., Westbank (CA), V4H 1H2

( * ) Notice: Subject to any disclaimer, the term of this patent is extended or adjusted under 35 U.S.C. 154(b) by 0 days.

(21) Appl. No.: 10/061,031

(22) Filed: Feb. 1, 2002

(65) Prior Publication Data

US 2002/0083663 A1 Jul. 4, 2002

Related U.S. Application Data

(60) Provisional application No. 60/256,867, filed on Feb. 5, 2001.

(51) Int. Cl.[7] ..... E06B 1/04

(52) U.S. Cl. ..... 52/211; 52/212; 52/204.1; 52/656.2; 52/656.4

(58) Field of Search ..... 52/211, 212, 204.1, 52/656.2, 656.4

(56) References Cited

U.S. PATENT DOCUMENTS

| | | | | |
|---|---|---|---|---|
| 3,032,837 A | | 5/1962 | Ramsey | |
| 3,148,754 A | | 9/1964 | Nardulli | |
| 3,364,623 A | | 1/1968 | Sklar | |
| 3,491,584 A | | 1/1970 | Selzer | |
| 3,875,713 A | | 4/1975 | Laborde | |
| 4,179,849 A | | 12/1979 | Kuffner | |
| 4,281,481 A | | 8/1981 | Wendt | |
| 4,330,972 A | | 5/1982 | Sailor | |
| 4,430,830 A | | 2/1984 | Sailor | |
| 4,974,366 A | | 12/1990 | Tizzoni | |
| 5,072,547 A | | 12/1991 | DiFazio | |
| 5,182,880 A | | 2/1993 | Berge, Jr. et al. | |
| 5,212,921 A | * | 5/1993 | Unruh | 52/204.1 |
| 5,613,324 A | | 3/1997 | Theune | |
| 5,758,458 A | * | 6/1998 | Ridge | 52/204.1 |
| 5,901,510 A | | 5/1999 | Ellingson | |
| D432,681 S | * | 10/2000 | Habeck et al. | D25/124 |

FOREIGN PATENT DOCUMENTS

| | | |
|---|---|---|
| CA | 2004357 | 12/1994 |

* cited by examiner

*Primary Examiner*—Carl D. Friedman
*Assistant Examiner*—Steven Varner
(74) *Attorney, Agent, or Firm*—Antony C. Edwards

(57) ABSTRACT

The rigid, generally planar, rectangular first sheet, at least one rigid sheet spacer mounted along, so as to protrude from, a first long edge of the first sheet, and a generally "U"-shaped first channel formed along a second long edge of the first sheet, where the second long edge is opposite the first long edge. The first channel opens towards the sheet spacer so as to define a cavity therebetween and along the length of the first sheet. The first channel is sized so as to fit over, as an end cap on, an exposed long edge of a door frame member such as a door jamb or a center frame member of for example a double width door when so fitted, a distal side wall of the first channel, distal from the first sheet, is mated to a first side of the exposed long edge of the door frame member. The first channel includes a channel spacer protruding into the cavity.

18 Claims, 4 Drawing Sheets

44
40
42
46
48

12
26
58
62
60
54
60
62
58
56
64
66

INSULATED METAL CLADDING FOR WOOD DOOR FRAME

CROSS REFERENCE TO RELATED APPLICATION

This application claims priority from U.S. Provisional Patent Application No. 60/256,867 filed Feb. 5, 2001 and Canadian Patent Application No. 2,343,642 filed Apr. 10, 2001 entitled Insulated Metal Cladding For Wood Door Frame.

FIELD OF THE INVENTION

This invention relates to a metal cladding which encloses all components of a wooden door jamb and which provides an exterior insulative space between the components and cladding which can be filled with insulative material.

BACKGROUND OF THE INVENTION

Exterior wooden door jambs manufactured for residential dwellings are subject to damage from moisture, ultra-violet radiation and from accidental causes. Such damage may result in a reduction of thermal efficiency around the door and jamb, thus requiring the home owner the expense and inconvenience associated with the repair or replacement of such damaged doors. In the past, to increase the durability and resistance to environmental elements of such wooden door jamb components they have been manufactured with a thin cladding of vinyl, aluminum or other suitable material such as seen illustrated in FIG. 1*a*, a view taken from U.S. Pat. No. 5,182,880 discussed below. Such covering material when secured to wood jamb components protects the underlying frame from damage but does not address the concerns of thermal insulation around the jamb.

Applicant is aware of U.S. Pat. No. 5,182,880, which discloses cladding material which is placed in contact with the door jamb components and secured thereto by a combination of screws, double-side tape and grooves or keys formed in the wooden door jamb components. The jamb components are engageable by inwardly projecting fins integrally formed with the cladding. The prior art, since the cladding is in contact with the door jamb, has insignificant affect on its thermal resistance.

It is an object of the present invention to provide cladding components which when secured to wooden door jamb components maintains a substantially continuous void between the jamb and the surrounding cladding, which can be filled with expanding foam insulative material. Further, in the present invention the cladding components are secured to wooden door jamb components so as to substantially avoid or minimize thermal conductivity through the jamb. Further, the cladding components of the present invention may have formed at locations where further thermal sealing is normally required, serrations for frictionally securing weather stripping or the like. Further, cladding of the present invention may be manufactured from aluminum having a wall thickness which adds significantly to the structural strength of the jamb, thereby, permitting a corresponding decrease in the thickness of the wooden components and an associated cost savings during manufacture.

SUMMARY OF THE INVENTION

In summary, the insulating cladding for wooden door frames of the present invention includes a rigid, generally planar, rectangular first sheet, at least one rigid sheet spacer mounted along, so as to protrude from, a first long edge of the first sheet, and a generally "U"-shaped first channel formed along a second long edge of the first sheet, where the second long edge is opposite the first long edge. The first channel opens towards the sheet spacer so as to define a cavity therebetween and along the length of the first sheet. The first channel is sized so as to fit over, as an end cap on, an exposed long edge of a door frame member such as a door jamb or a center frame member of for example a double width door when so fitted, a distal side wall of the first channel, distal from the first sheet, is mated to a first side of the exposed long edge of the door frame member. The first channel includes a channel spacer protruding into the cavity.

The sheet spacer is mountable flush against a second side of the door frame member, the second side of the door frame member opposite the first side of the door frame member. This is to maintain the cavity substantially air-imperviously sealed around the door frame member when the insulating cladding is mounted to the door frame member. When so mounted the channel spacer and the sheet spacer respectively maintain the base of the channel and the first sheet spaced from the exposed long edge of the door frame member and the second side of the door frame member respectively.

Where the door frame member is a door jamb the channel spacer is the distal side wall of the first channel, adapted to be mountable to the first side of the door frame member. For example, the distal side wall may be notched to snugly mount against the exposed long edge of the door frame member and, contiguously, the first side of the door frame member.

In one embodiment, the base of the first channel may be generally perpendicular to the first sheet, and a second channel may be formed in the base. The second channel may open in oppositely disposed relation to the first channel for receiving in locking engagement in the second channel a locking member of an elongate moulding. Again, where the door frame member is a door jamb, the insulating cladding may further comprise the elongate moulding, wherein the elongate moulding is sized to cover an airspace between the door jamb and an adjacent wall frame member. Such a moulding may also be insulating, for example it may be hollow to create an insulating air space or filled with a commercial insulating material.

In one embodiment the sheet spacer may be a rigid flange extending rigidly from the first sheet. The rigid flange may form, with the first long edge of the first sheet, a third channel, wherein the third channel is in opposed facing relation to the first channel. A side wall of the third channel, opposite the first long edge, may be adapted for fastening by a fastener to the second side of the door frame member. The rigid flange may extend the length of the first long edge of the first sheet so as to seal the cavity against the door frame member. The one sheet spacer may also include a second rigid flange extending rigidly from the first sheet and parallel to, and spaced from the first rigid flange. The second rigid flange may form a fourth channel in opposed facing relation to the first channel.

Where the door frame member is a center member of a door frame for a double width door for example, the insulating cladding further comprises a second sheet which, like the first sheet, is a rigid, generally planar, rectangular sheet. The second sheet is parallel to the first sheet. A second sheet spacer is mounted along a first edge of the second sheet. The second sheet is rigidly mounted to the side wall of the channel, referred to above as the distal side wall, along a second edge of the second sheet opposite the first edge of the second sheet. The second sheet spacer is flush mounts to the first side of the door frame member when the insulating cladding is mounted to the door frame member. The second sheet and the second sheet spacer define, with the first channel, a second cavity in opposed facing relation to the first cavity. The second sheet spacer may be a rigid flange extending rigidly from the second sheet. This rigid flange may also form a channel in opposed facing relation to the first channel. In this case, the channel spacer may be at least one channel flange extending between the base of the channel and the exposed long edge of the door frame member. The channel flange may extend perpendicularly to the base of the channel so as to engage the exposed long edge of the door frame member when the insulating cladding is mounted on the exposed long edge.

DETAILED DESCRIPTION OF EMBODIMENTS OF THE INVENTION

Figure 1:
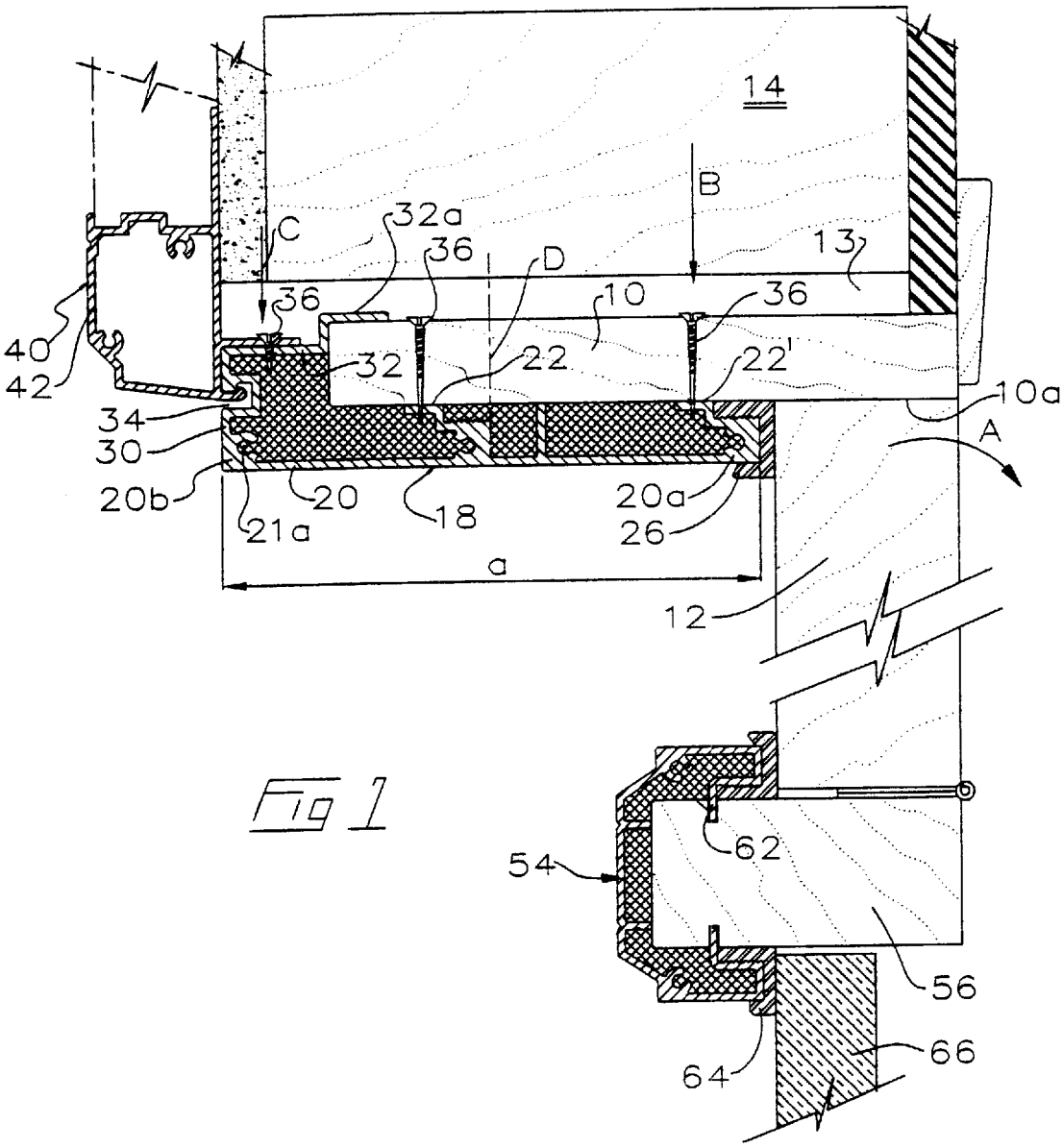
FIG. 1 is a horizontal sectional view through a portion of a door jamb according to the present invention.
Figure 1A:
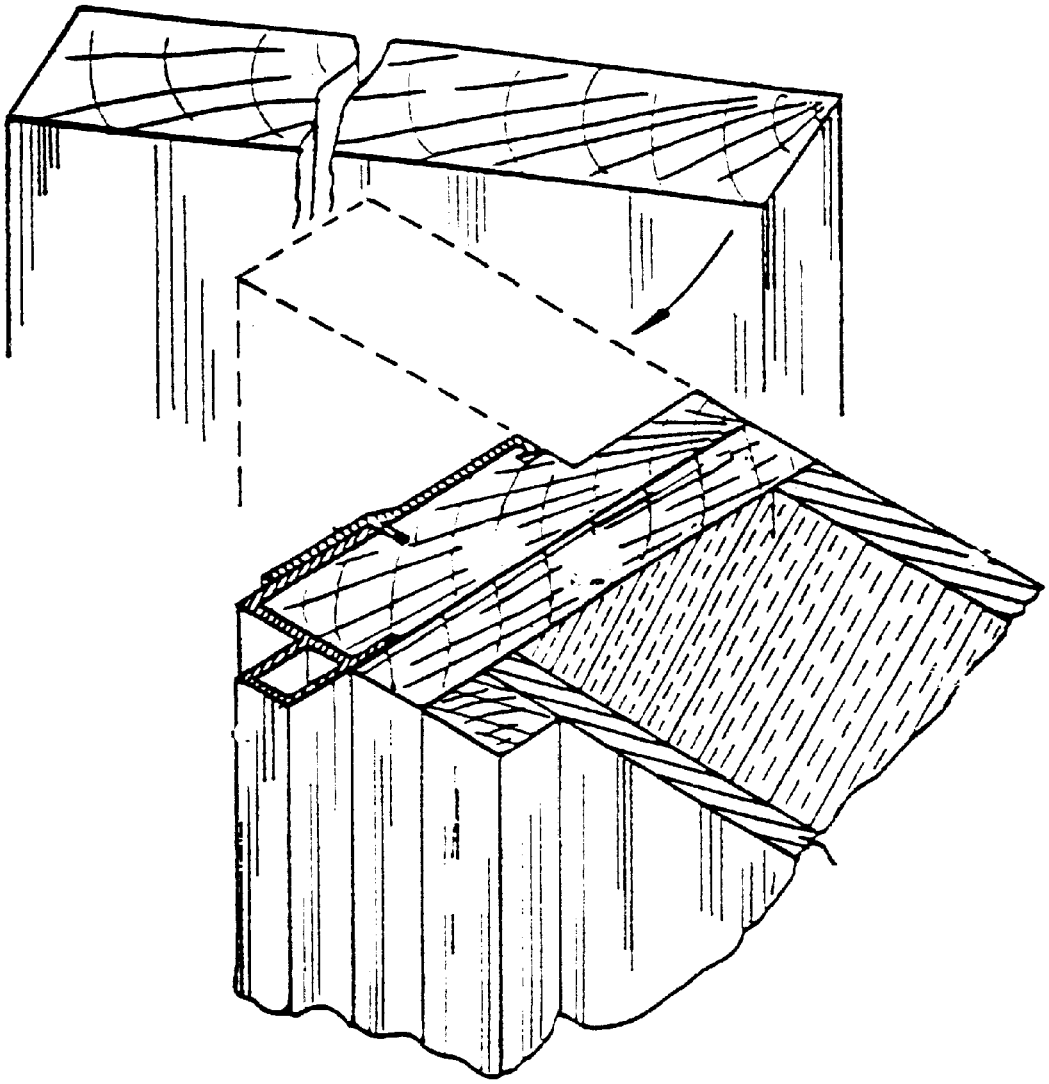
FIG. 1a PRIOR ART
FIG. 1*a* is an isometric view partially in section illustrating prior art metal cladding for wooden door frames.

With reference to the accompanying drawing figures, wherein similar reference characters denote corresponding parts in each view, a typical wooden doorjamb 10, as seen in FIG. 1, will encompass on its inner surfaces 10*a* mounted exterior residential door 12, such as sometimes referred to as a "pre-hung" door. Door 12 opens in direction A into the interior of the dwelling. Door jamb 10 is typically shimmed into place, and mounted to, vertical frame members 14 which have been framed to receive door 12 and its door jambs 10 so as to leave shim space 13.

Figure 2:
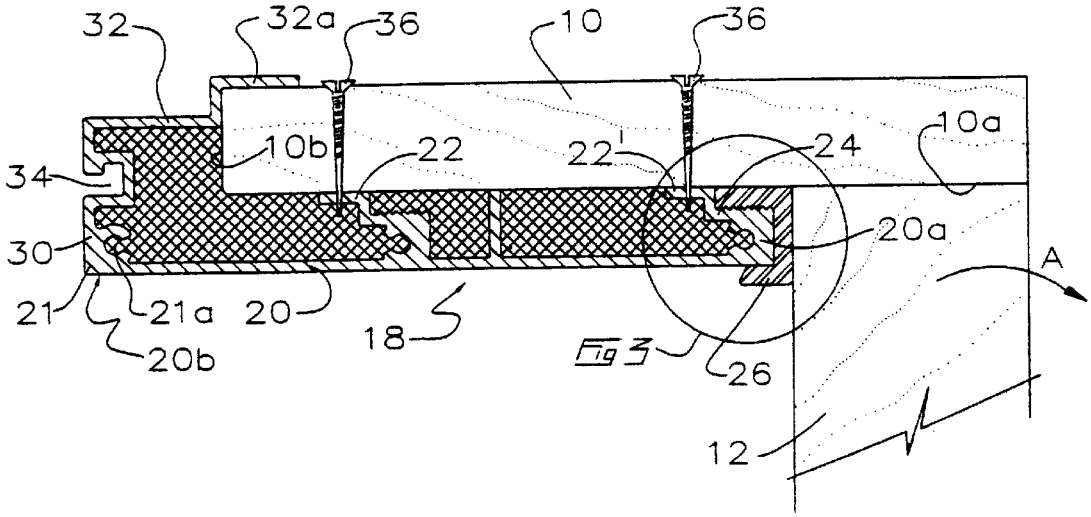
FIG. 2 is a sectional view through the metal jamb cladding component of FIG. 1.
Figure 3:
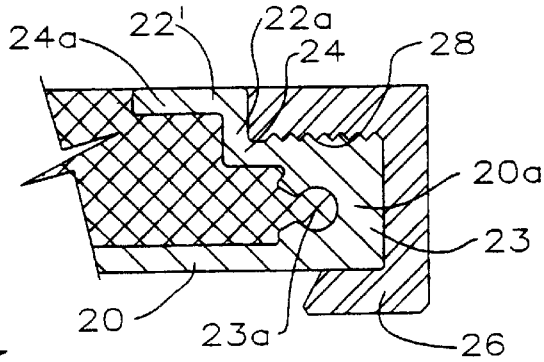
FIG. 3 is an enlarged view of a portion of FIG. 2.

The jamb cladding 18, also seen in FIGS. 2 and 3, encloses the outer edge 10*b* of frame 10, and has a first surface member 20 positioned generally parallel to door jamb 10. First surface member 20 has spacing tabs 22 and 22' extending therefrom, which when brought into contact with inner face 10*a* of door jamb 10 position first surface 20 spaced from, and parallel to, inner surface 10*a* of jamb 10. Two spacing tabs 22 are shown in this embodiment, not intended to be limiting, which allows for trimming away of tab 22' along line D (seen in FIG. 1) so that cladding 18 may be used on, for example, a 4½ inch jamb (measured along dimension line a) instead of a 6½ inch jamb.

First end 20*a* of jamb cladding 18 has a spacing tab 22*a* (seen in FIG. 3) which has a first leg 24 spaced from inner face 10*a* of door jamb 10. A screw port 23*a* is formed in the strengthening fillet 23 of first end 20*a*. A second leg 24*a* extends outwardly from first leg 24 to contact the inner surface 10*a* of jamb 10. Weather stripping 26 when inserted into the recess between inner surface 10*a* of jamb 10 and first leg 24 is retained therein by serrations 28 which are formed on first leg 24.

Second end 20*b* of first surface member 20 is generally 'U' shaped and is spaced outwardly from and wraps around outer end 10*b* of frame 10. Second end 20*b* has a first leg 30 extending generally perpendicular to form the base of the "U"-shape and a second leg 32 which extends inwardly from, and generally perpendicular to first leg 30, to contact the exterior edge 10*b* of doorjamb 10. Second leg 32 is offset where it contacts outer edge 10*b* of jamb 10, an end 32*a* of leg 32 overlapping a portion of jamb 10. First leg 30 has a locking recess 34 formed therein. A screw port 21*a* is formed in corner strengthening fillet 21 of second end 20*b*.

Cladding 18 and door jamb 10 are secured together by means of screws 36 or other fasteners which are driven in direction B from the outside of jamb 10 during its assembly, and through so as to engage at least one of spacing tabs 22 or 22'. The void between cladding 18 and door jamb 10 may be filled with expanding foam insulation.

Figure 4:
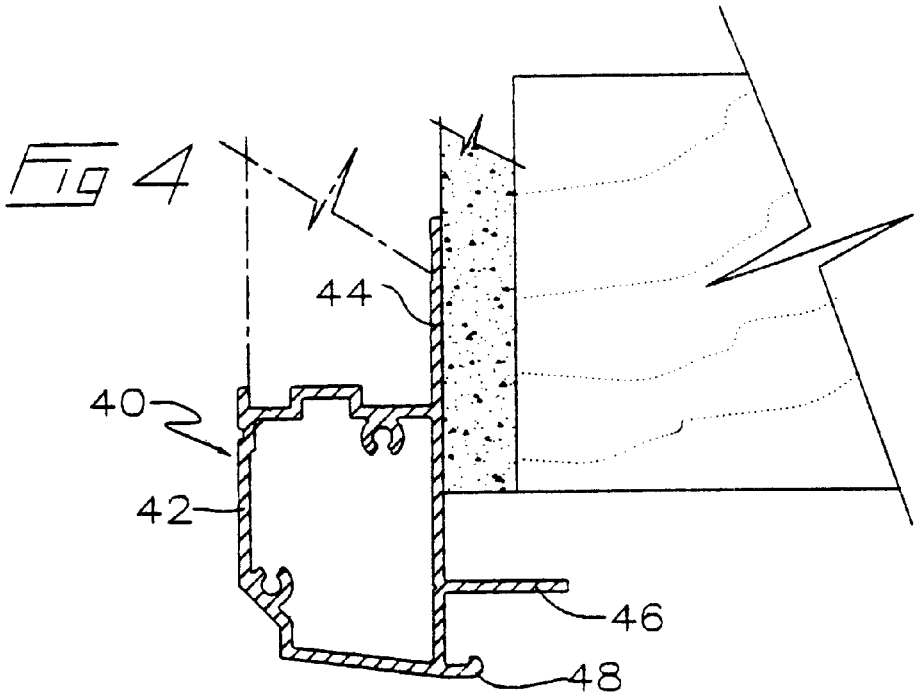
FIG. 4 is a horizontal sectional view through a metal brickmould cladding component according to the present invention.

As better seen in FIG. 4, brickmould 40 has a generally rectangularly shaped body 42 when viewed in cross section, having an elongated first arm 44 extending on one side thereof, a first tab 46 extending generally at right angles from first arm 44 and a locking tab 48 extending, also, generally at right angles from the first arm and generally parallel to first tab 46.

Elongated first arm 44 of brickmould 40 extends generally parallel to an exterior wall surface of a dwelling, with the rectangular body 42 being located outwardly therefrom. Exterior wall surfacing will fit snugly against body 42 without the need for sealant such as silicone caulking. First tab 46 is positioned during assembly, adjacent to the second inwardly extending leg 32 of jamb cladding 18. Locking tab 48 is frictionally retained, without the need for silicone sealant or the like, within the locking recess 34 of the jamb 10. Brickmould 40 is secured to jamb cladding 18 by screws 36 driven in direction C through second leg 32 during assembly. As with jamb cladding 18, body 42 of brickmould 40 may be filled with expanding foam insulation.

Figure 5:
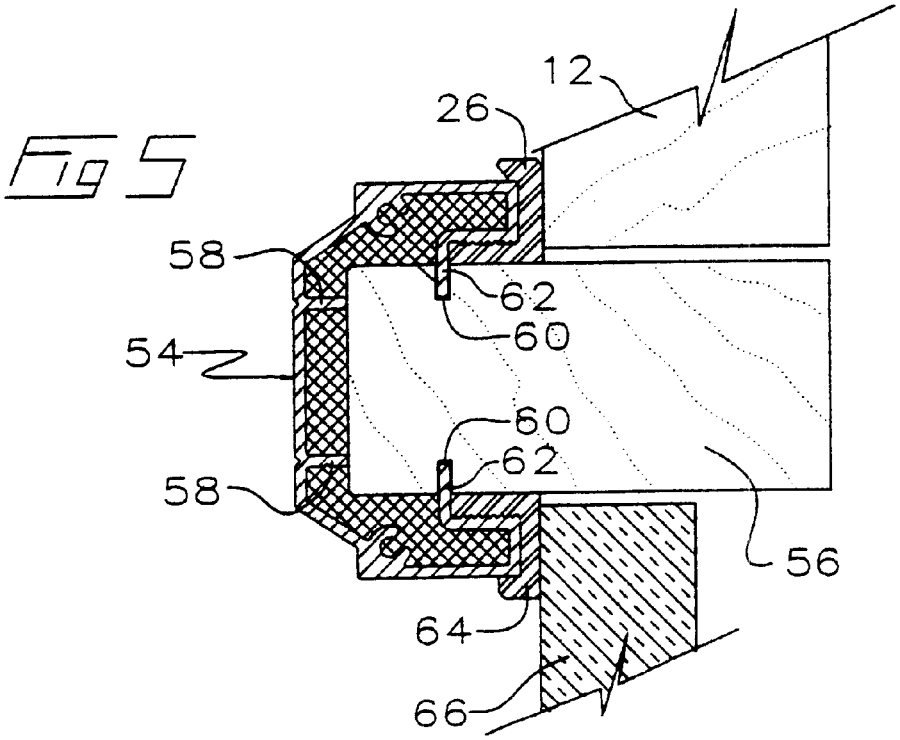
FIG. 5 is a sectional view through a metal tee-bar cladding component.

In cases where the vertical door frame is adjacent to a side glazing panel or window, a tee-bar cladding 54, such as illustrated in FIG. 5, may be employed. Cladding 54 is generally 'U' shaped in cross section, being designed to fit over projecting wood framing 56. Inwardly projecting spacing tabs 58 of tee-bar cladding 54 maintains a void around an end of framing 56. Framing 56 has locking recesses 60 formed on opposite sides into which mirror image inwardly projecting arms 62 formed on tee-bar cladding 54 are inserted. Arms 62 are suitably formed so that weather stripping 64 can be inserted between framing 56, arm 62 and on one side glazing 66 or on the other side residential door 12. The void between an end of framing 56 and tee-bar cladding component 54 may be filled with expanding foam insulation.

It will be noted that all connections between jamb and frame components are insulated and inhibit thermal transmission to the interior of the dwelling. Connection between the aluminum jam cladding and the tee-bar cladding component is a weather tight 'snap' connection avoiding the need for further caulking.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. Insulating cladding for wooden door frames comprising:

a rigid, generally planar, rectangular first sheet, at least one rigid sheet spacer mounted along, so as to protrude from, a first long edge of the first sheet, a generally "U"-shaped first channel formed along a second long edge of the first sheet, opposite the first long edge, the first channel opening towards the at least one sheet spacer so as to define a cavity therebetween and along the length of the first sheet, the first channel sized so as to fit over, as an end cap on, an exposed long edge of a door frame member and when so fitted, with a distal side wall of the first channel, distal from the first sheet, mated to a first side of the exposed long edge of the door frame member, the first channel including a channel spacer protruding into the cavity, the at least one sheet spacer mountable flush against a second side of the door frame member, the second side opposite the first side of the door frame member, so as to maintain the cavity substantially air-imperviously sealed around the door frame member when the insulating cladding is mounted to the door frame member, and when so mounted the channel spacer and the at least one sheet spacer respectively maintaining a base of the channel and the first sheet spaced from the exposed long edge of the door frame member and the second side of the door frame member respectively.

2. The insulating cladding of claim 1 wherein the channel spacer is the distal side wall of the first channel, adapted to be mountable to the first side of the door frame member.

3. The insulating cladding of claim 2 wherein the distal side wall is notched to snugly mount against the exposed long edge of the door frame member and, contiguously, the first side of the door frame member.

4. The insulating cladding of claim 1 wherein the base of the first channel is generally perpendicular to the first sheet, a second channel formed in the base, the second channel opening in oppositely disposed relation to the first channel for receiving in locking engagement therein a locking member of an elongate moulding.

5. The insulating cladding of claim 4 wherein the door frame member is a doorjamb, the insulating cladding further comprising the elongate moulding, the elongate moulding sized to cover an airspace between the door jamb and an adjacent wall frame member.

6. The insulating cladding of claim 5 wherein the moulding is insulating.

7. The insulating cladding of claim 6 wherein the moulding is hollow.

8. The insulating cladding of claim 1 wherein the at least one sheet spacer is a rigid flange extending rigidly from the first sheet.

9. The insulating cladding of claim 8 wherein the rigid flange forms, with the first long edge of the first sheet, a third channel, the third channel in opposed facing relation to the first channel.

10. The insulated cladding of claim 9 wherein a side wall of the third channel, opposite the first long edge, is adapted for fastening by a fastener to the second side of the door frame member.

11. The insulating cladding of claim 8 wherein the rigid flange extends the length of the first long edge of the first sheet.

12. The insulating cladding of claim 8 wherein the at least one sheet spacer includes a second rigid flange extending rigidly from the first sheet and parallel to the rigid flange.

13. The insulating cladding of claim 12 wherein the second rigid flange forms a fourth channel in opposed facing relation to the first channel.

14. The insulating cladding of claims 1–13 further comprising a rigid, generally planar, rectangular second sheet parallel to the first sheet and a second sheet spacer mounted along a first edge of the second sheet, the second sheet rigidly mounted to the distal side wall along a second edge of the second sheet opposite the first edge of the second sheet, the second sheet spacer flushly mounting to the first side of the door frame member when the insulating cladding is mounted to the door frame member, the second sheet and the second sheet spacer defining, with the first channel, a second cavity in opposed facing relation to the cavity.

15. The insulating cladding of claim 14 wherein the second sheet spacer is a third rigid flange extending rigidly from the second sheet.

16. The insulating cladding of claim 15 wherein the third rigid flange forms a fifth channel, the fifth channel in opposed facing relation to the first channel.

17. The insulating cladding of claim 14 wherein the channel spacer is at least one channel flange extending between the base and the exposed long edge of the door frame member.

18. The insulating cladding of claim 17 wherein the at least one channel flange extend perpendicular to the base so as to engage the exposed long edge of the door frame member when the insulating cladding is mounted on the exposed long edge.

* * * * *